US006319050B1

(12) United States Patent
Miyazaki et al.

(10) Patent No.: US 6,319,050 B1
(45) Date of Patent: Nov. 20, 2001

(54) LOCKING MECHANISM IN CONNECTOR

(75) Inventors: Sho Miyazaki; Souji Kihira, both of Nagoya (JP)

(73) Assignees: Autonetworks Technologies, Ltd., Nagoya; Sumitomo Wiring Sysems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/659,711

(22) Filed: Sep. 11, 2000

(30) Foreign Application Priority Data

Oct. 14, 1999 (JP) ..... 11-292256

(51) Int. Cl.[7] ..... H01R 3/00; H01R 13/62
(52) U.S. Cl. ..... 439/489; 439/157
(58) Field of Search ..... 439/489, 352, 439/188, 488, 490, 350, 357, 372, 157

(56) References Cited

U.S. PATENT DOCUMENTS 5,135,410 8/1992 Kawase et al. .
5,174,786 * 12/1992 Kato et al. ..... 439/489
5,997,321 12/1999 Nakata et al. .

FOREIGN PATENT DOCUMENTS 1-166977 11/1989 (JP) .
2-150776 12/1990 (JP) .

* cited by examiner

*Primary Examiner*—Tulsidas Patel
*Assistant Examiner*—Chandrika Prasad
(74) *Attorney, Agent, or Firm*—Oliff & Berridge, PLC

(57) ABSTRACT

To provide a connector in which detection of a locked state can be made with a simple structure. When a lever 30 has been rotated to a normal position, a lock arm 35 provided on the lever 30 is engaged with a lock part 25 provided on a male housing 20, whereby a female housing 10 and the male housing 20 are held undetachably. At the same time, a detecting body 50 assembled to the lock arm 35 will be released from the locked condition where a locking claw 56 of the detecting body is abutted against an engaging face 40 of an engaging portion 38 of the lock arm 35 thereby to restrict a pushing movement. Thus, the detecting body 50 will be allowed to move to be pushed in the same direction of the rotation direction of the lever 30.

2 Claims, 13 Drawing Sheets

LOCKING MECHANISM IN CONNECTOR

BACKGROUND OF THE INVENTION

1. Field of the Invention

The present invention relates to a locking mechanism in a connector.

2. Description of the Related Art

There has been a connector provided with a lever which is rotatably assembled to either one of female and male housings in order to conduct an easy coupling of the housings. The lever is provided with a cam groove for introducing a mating housing, while the mating housing is provided with a pin projecting therefrom which can be inserted into the cam groove. For coupling both the housings, the lever is rotated with the pin inserted in the cam groove, and the housings are normally engaged with each other when the lever has arrived at a normal position.

However, it has sometimes happened that an operator suspends the rotating operation because he considers by mistake that the normal engagement of both the housings have been completed although the lever has not yet arrived at the normal position. On occurrence of such situation, the housings are left in a half engaged state.

Therefore, in order to be able to detect that the lever has been rotated up to the normal position, there has been proposed a connector having electrical detecting means in Japanese Publication No. JP-A-9-167657 of an unexamined Patent Application. In this connector, a lever and a mating housing are respectively provided with connecting terminals which can be contacted only when the lever has been normally rotated. Lead wires connected to the connecting terminals are guided to an exterior of the connector respectively and connected to a detecting circuit, which will be actuated by an electric signal transmitted according to a contact between both the connecting terminals.

In the connector having such detecting means of an electrical type, it has been necessary to provide a large detecting apparatus including the connecting terminals, lead wires and detecting circuit as described above, and accordingly, a number of components have been required, which results in an increase of manufacturing cost and incurs a large size of the connector.

SUMMARY OF THE INVENTION

The invention has been completed based on the above described circumstances, and its object is to provide a connector in which detection of a locked state can be made with a simple structure.

To achieve the above described object, according to a first aspect of the invention, there is provided a locking mechanism in a connector which comprises a connector housing and a member which is relatively displaced with respect to the connector housing, a lock arm and a lock part respectively provided on the connector housing and the member and adapted to engage with each other thereby to hold the connector housing and the member undisplaceably, the lock arm being adapted to be elastically restored and engaged with the lock part, after the lock arm has been flexibly deformed with relative displacement of the connector housing and the member while overriding the lock part, characterized in that a detecting body which can be pushed in a direction of the relative displacement of the connector housing and the member is assembled to either one of the lock arm and the lock part, a guide face for guiding an overriding motion of the lock arm is provided on a tip end of a counterpart of the one to which the detecting body is assembled, the detecting body being abutted against an engaging part of the lock arm or the lock part to which the detecting body is assembled thereby to restrict pushing movement of the detecting body during the displacement of the connector housing and the member, while the engaging part is engaged with the counterpart when both the connector housing and the member have arrived at a position where they are held, whereby the restricted condition of the detecting body is released and the pushing movement of the detecting body is guided along the guide face.

According to a second aspect of the invention, there is provided the locking mechanism in the connector as defined in the first aspect, which further comprises a mating connector housing which is engageable with the connector housing, and either one of both the connector housings is provided with a lever which is engaged with the other connector housing as the member and adapted to bring both the connector housings into an engagement by a rotating operation of the lever, characterized in that the lock arm and the lock part are respectively provided on the lever and on either one of both the connector housings, and the detecting body is assembled to the lever, whereby when the lever has been normally rotated, the lock arm and the lock part are engaged with each other to normally engage both the connector housings with each other, and the detecting body is released from the restricted condition and allowed to be moved to be pushed in the same direction as the rotation direction of the lever.

According to a third aspect of the invention, there is provided the locking mechanism in the connector as defined in the first or second aspect, wherein when the detecting body is pushed in, it is flexibly deformable while riding on the lock arm and the lock part, and a pushing end of the detecting body is provided with a locking claw which is lockable with an opposite side to the engaging part in the one of the lock arm and the lock part to which the detecting body is assembled.

According to the first aspect of the invention, the detecting body is abutted against the engaging part of the lock arm or the lock part to which the detecting body is assembled while the connector housing and the member are relatively displaced, whereby the pushing movement of the detecting body is restricted. When the connector housing and the member have arrived at the position where they are held, the engaging part which has restricted the movement of the detecting body is engaged with the counterpart, thereby to release the restricted state of the detecting body. By further pushing the detecting body in this state, the detecting body will be guided along the guide face of the counterpart and the pushing movement of the same will be allowed.

In other words, whether the connector housing and the member are held undisplaceably or not can be detected by whether or not the detecting body can be pushed in.

Because this detecting body has a simple structure as compared with the detecting apparatus of the electrical type in the conventional case, it is possible to impart a lock detecting function to the connector at a low cost while keeping the connector in a small size. Moreover, because both the riding motion of the lock arm on the lock part and the pushing movement of the detecting body can be guided by the single guide face, a compact structure will be realized.

According to the second aspect of the invention, the lever corresponds to the member defined in the first aspect, the rotation direction of the lever corresponds to the relatively displacing direction of the member with respect to the connector housing.

Because the operation of pushing the detecting body can be naturally incorporated in the operation of rotating the lever, there is no need of adding a particular operation as the detecting operation of the detecting body, and workability will not be sacrificed.

According to the third aspect of the invention, by means of the locking claw of the detecting body, the engaged state of the lock arm and the lock part can be doubly locked.

BRIEF DESCRIPTION OF THE DRAWINGS

FIG. 13 is an enlarged sectional side view showing a process wherein the detecting body is moved to be pushed in;

DETAILED DESCRIPTION OF THE PREFERRED EMBODIMENTS

Figure 1:
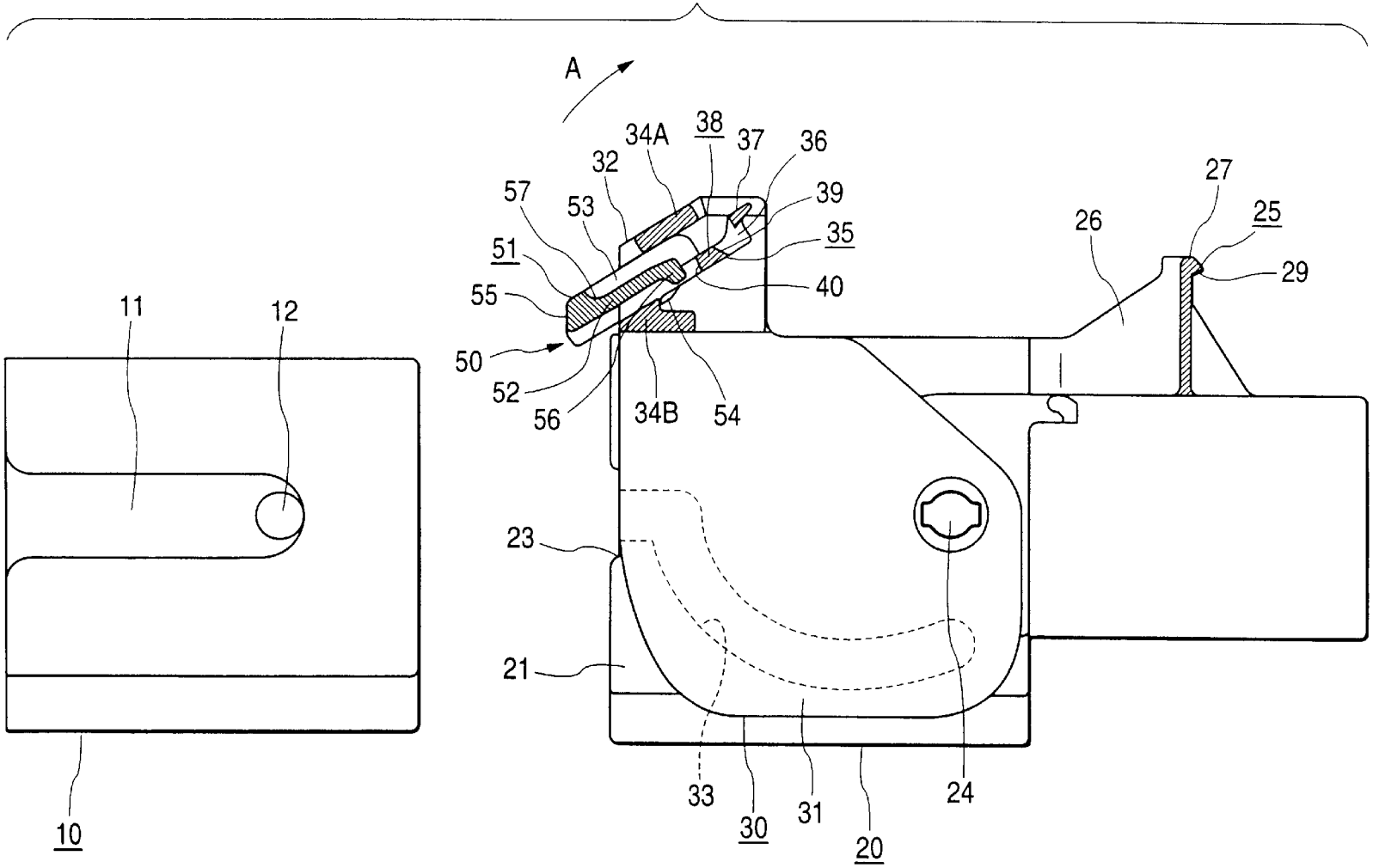
FIG. 1 is a side view of a connector according to an embodiment of the invention partly cut away.

An embodiment according to the invention will be described referring to FIGS. 1 to 15. A connector in this embodiment includes a female connector housing 10 as shown on the left hand in FIG. 1 (hereinafter referred to simply as the female housing 10) and a male connector housing 20 as shown on the right hand (hereinafter referred to simply as the male housing 20) which are adapted to be engaged with each other by rotating a lever 30 assembled to the male housing 20. Faces of both the housings 10 and 20 at which they are engaged with each other are referred to as forward sides respectively.

In this embodiment, the male housing 20 corresponds to "a connector housing" described in claim 1 in the scope of claims for patent, and the lever 30 corresponds to "a member which is relatively displaced with respect to the connector housing" described in claim 1.

The female housing 10 is formed substantially in a shape of a block, and capable of containing inside a plurality of male terminal lugs which are not shown in the drawings. On both outer side faces of the female housing 10, are provided a pair of ribs 11 extending from a rather forward position of a center in a longitudinal direction to a rearward end thereof. A pair of follower pins 12 which are adapted to be projected forward and engaged in cam grooves 33 of the lever 30 are provided in forward ends of the ribs 11.

Figure 2:
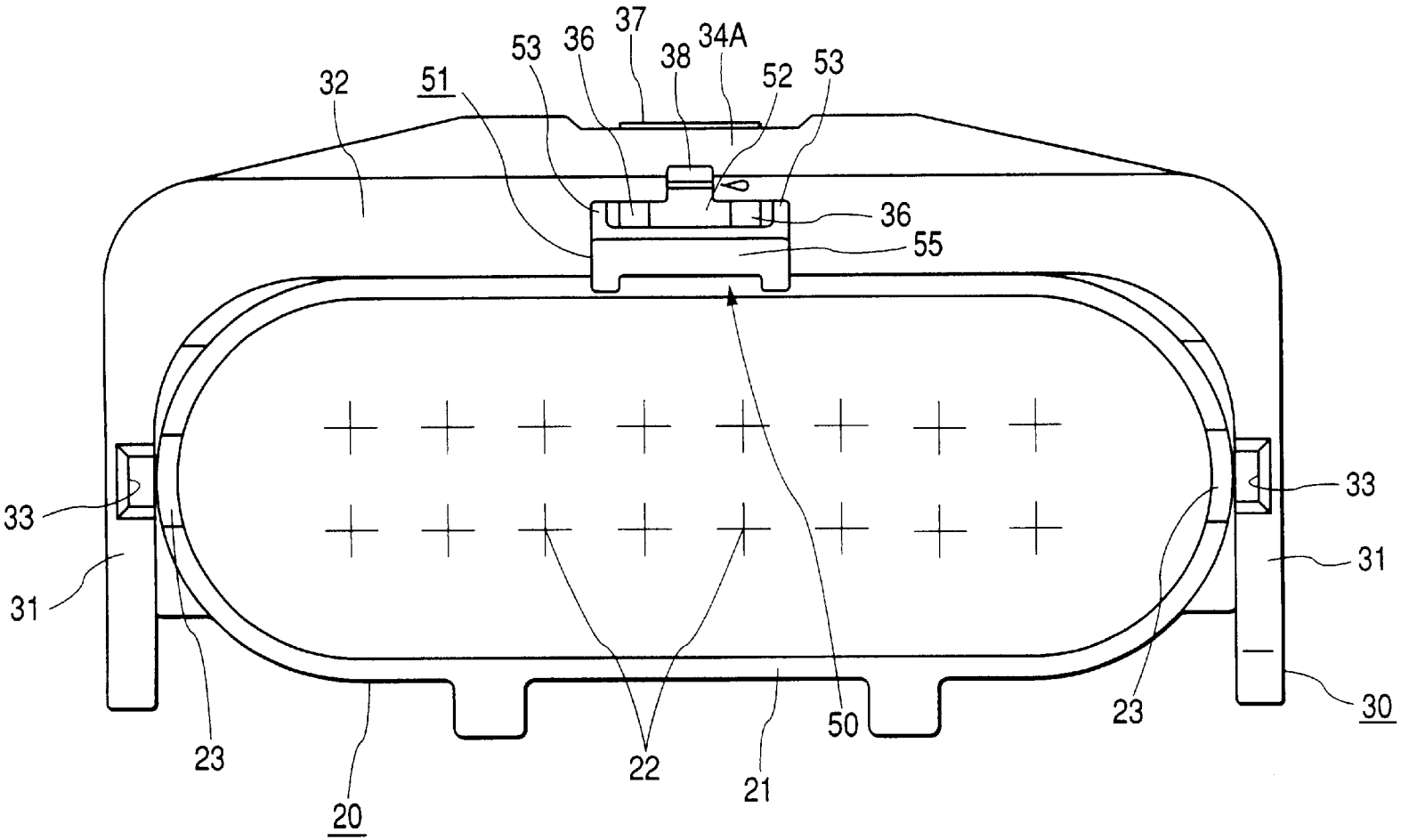
FIG. 2 is a front view of a male housing.

The male housing 20 is provided with a hood 21 which is open at its forward end as shown in FIGS. 1 and 2, and the female housing 10 is adapted to be fitted in the hood 21. The male housing 20 has a plurality of cavities 22 arranged in parallel in which male terminal lugs adapted to be connected with the female terminal lugs can be contained, as schematically shown in FIG. 2. Side walls of the hood 21 are respectively provided with openings 23 into which the ribs 11 of the female housing 10 can be inserted. On both outer side faces of this male housing 20, are provided a pair of projected shaft portions 24 by means of which the lever 30 is assembled.

The lever 30 is formed in a shape of a gate as a whole, and arranged in contact with the outer side faces of the male housing 20, including a pair of leg portions 31 to be assembled to the projected shaft portions 24 and a connecting portion 32 for connecting these leg portions 31. This lever 30 is rotatable in a direction of an arrow A around the projected shaft portions 24.

Figure 10:
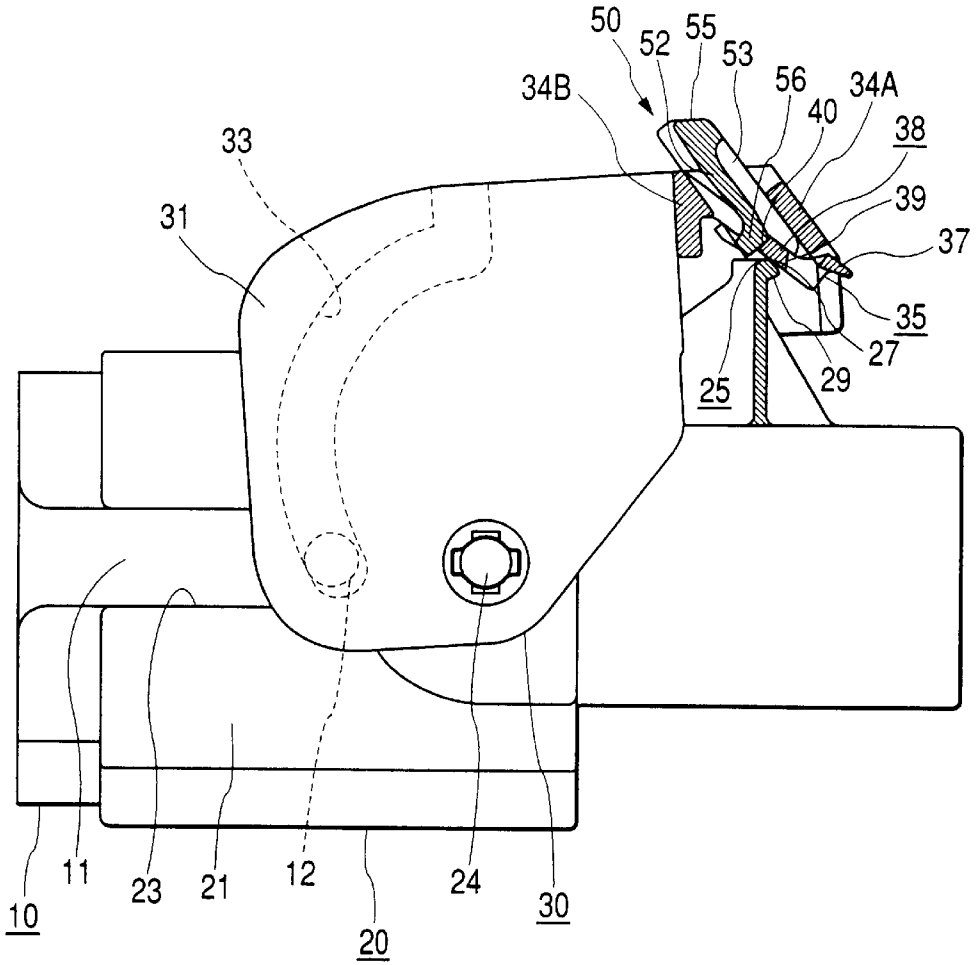
FIG. 10 is a side view partly cut away showing a state wherein an engaging portion of a lock arm has ridden on the lock part.

As shown in FIGS. 1 and 2, inner faces of the leg portions 31 are provided with cam grooves 33 into which the follower pins 12 of the female housing 10 are adapted to be inserted. Outlets of these cam grooves 33 are directed forward in a state before the lever 30 is rotated so that the follower pins 12 can be inserted, and according to the rotation of the lever 30, the follower pins 12 can be moved along the cam grooves 33 as shown in FIG. 10.

Figure 3:
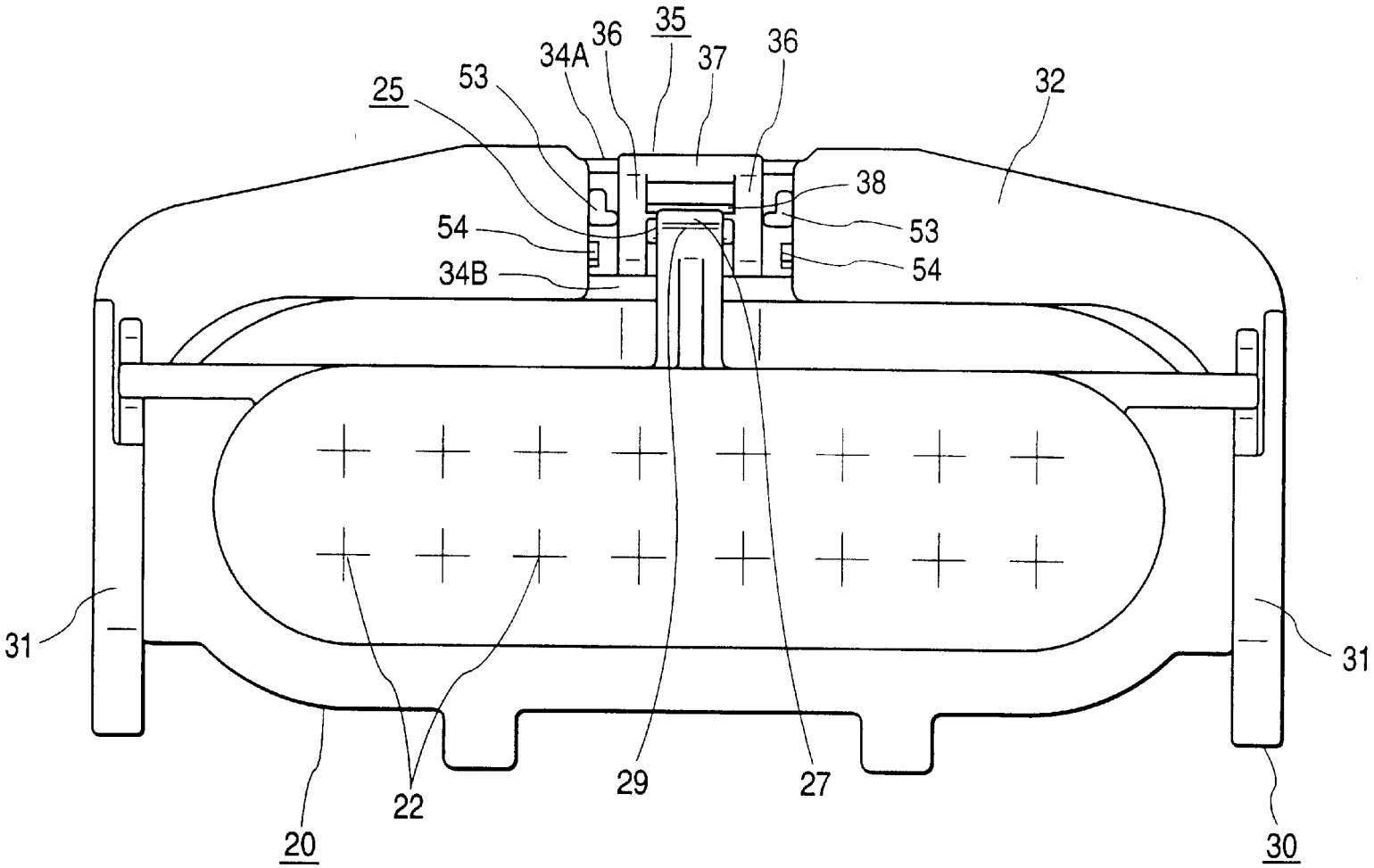
FIG. 3 is a back view of the male housing.

As shown in FIG. 3, the connecting portion 32 is in contact with an upper face of the male housing 20 in a state before the lever 30 is rotated. At a middle part of the connecting portion 32 in a widthwise direction of the male housing 20, is formed a space which is inclined backwardly upwardly and open at its forward and rearward ends leaving two upper and lower bridge portions 34A, 34B as shown in FIG. 1. In other words, this open space is open in a direction along the rotation direction of the lever 30.

A lock arm 35 in a cantilever form is provided projecting from the lower bridge portion 34B along the open space. As shown in FIG. 3, this lock arm 35 is composed of a pair of arm portions 36 which are arranged laterally with a slight distance therebetween, and an operating portion 37 and an engaging portion 38 which connect the arm portions 36 at two positions back and forth like a ladder.

The arm portions 36 are flexibly deformable in a direction of approaching the upper bridge portion 34A as shown in FIG. 1, and their free ends are projected changing their projection angles directly upward. The operating portion 37 is coupled between the free ends of the arm portions 36, and the engaging portion 38 is connected to the arm portions 36 at diagonally downward positions in the drawing with a slight distance from the operating portion 37. The lock arm 35 can be forced to be flexibly deformed by operating the operating portion 37.

Figure 11:
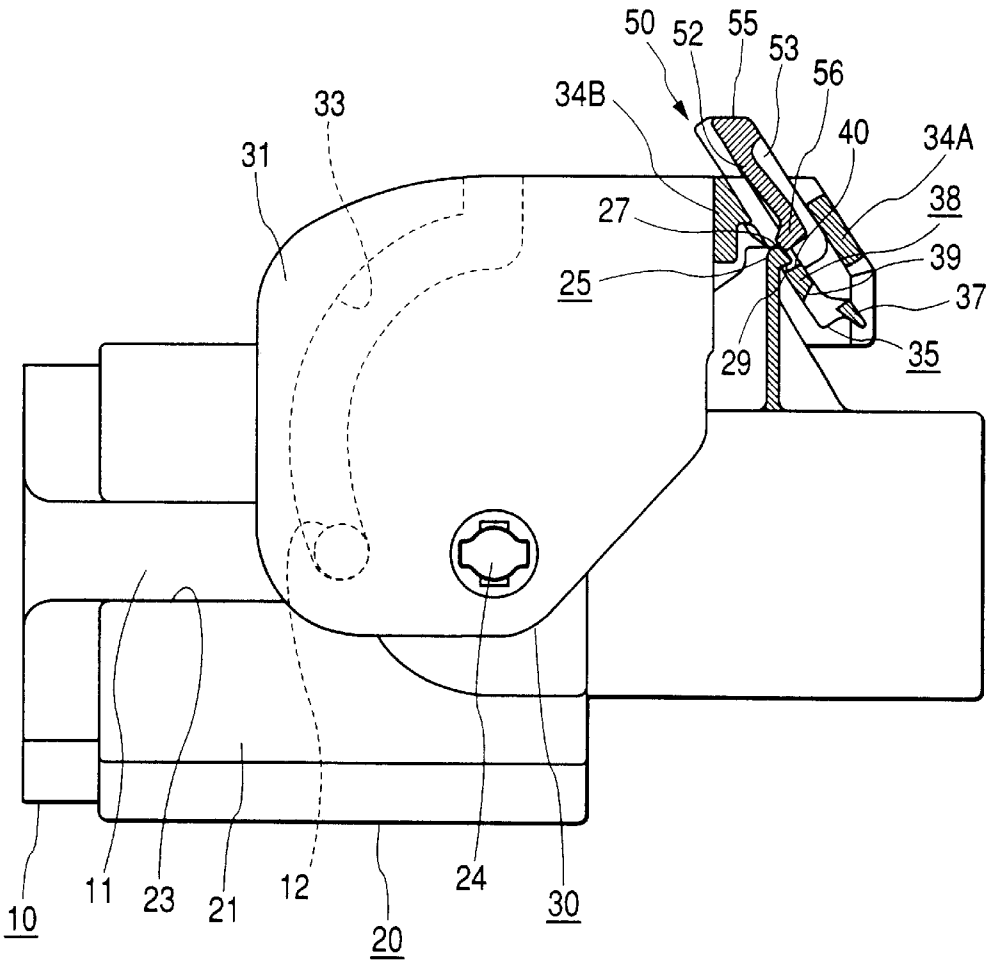
FIG. 11 is a side view partly cut away showing a state wherein the lever has been rotated to a normal position.

After a tip end face 39 of the engaging portion 38 has been abutted against a below described lock part 25 of the male housing 20 with the rotation of the lever 30, the lock arm 35 is adapted to be flexibly deformed as shown in FIG. 10. Meanwhile, an engaging face 40 of the engaging portion 38 on an opposite side to the tip end face 39 becomes engageable with the lock part 25 as shown in FIG. 11. A position of the lever 30 on this occasion is referred to as a normal position. Both the housings 10 and 20 are brought into a normally engaged condition in which they are held undetachably, when the lever 30 has arrived at the normal position.

Figure 4:
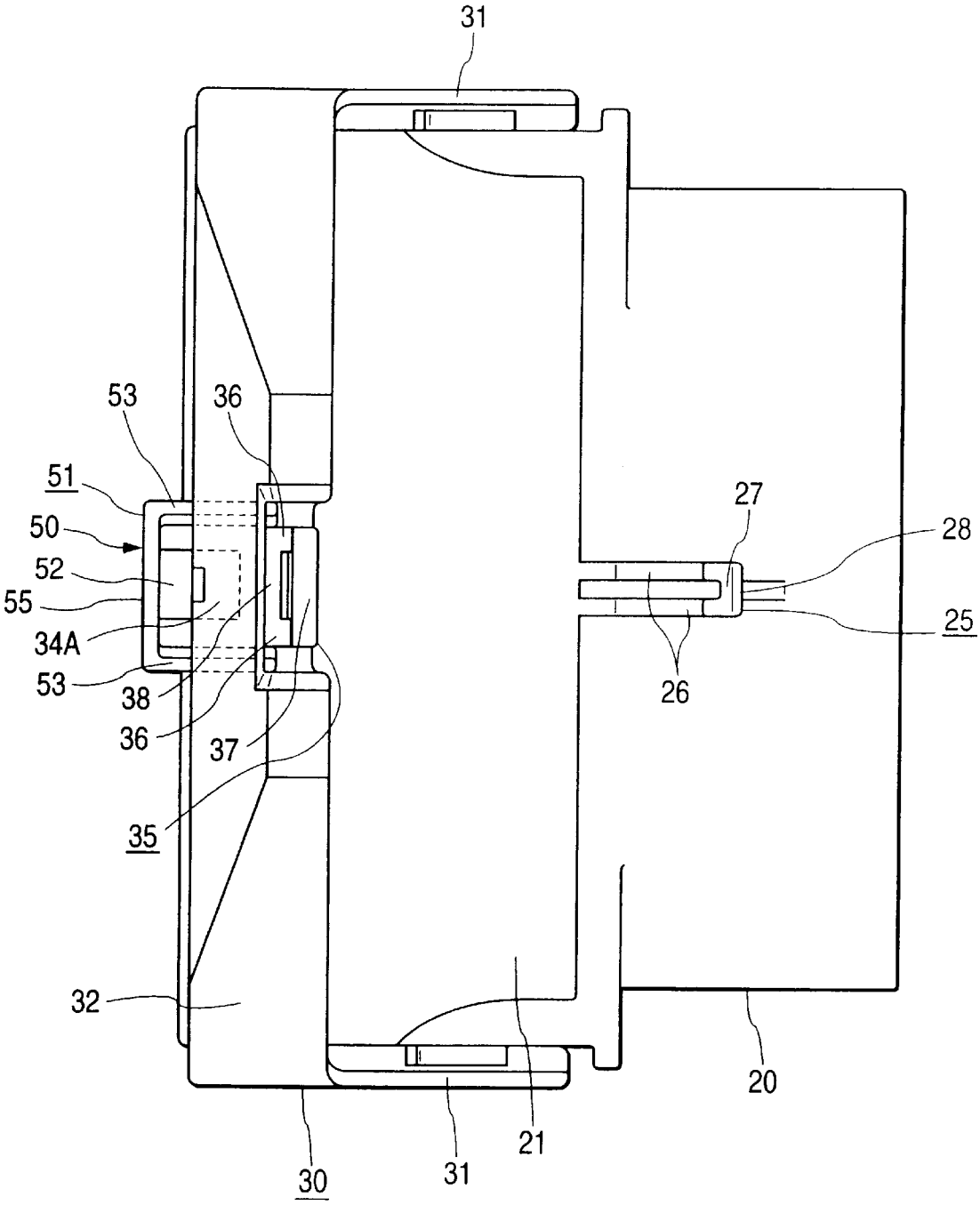
FIG. 4 is a plan view of the male housing.
Figure 5:
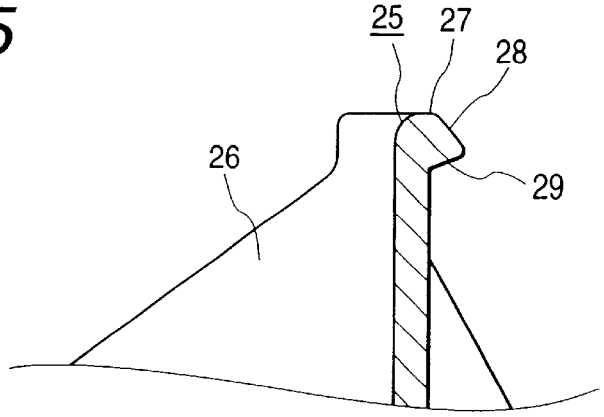
FIG. 5 is an enlarged sectional side view of a lock part.
Figure 12:
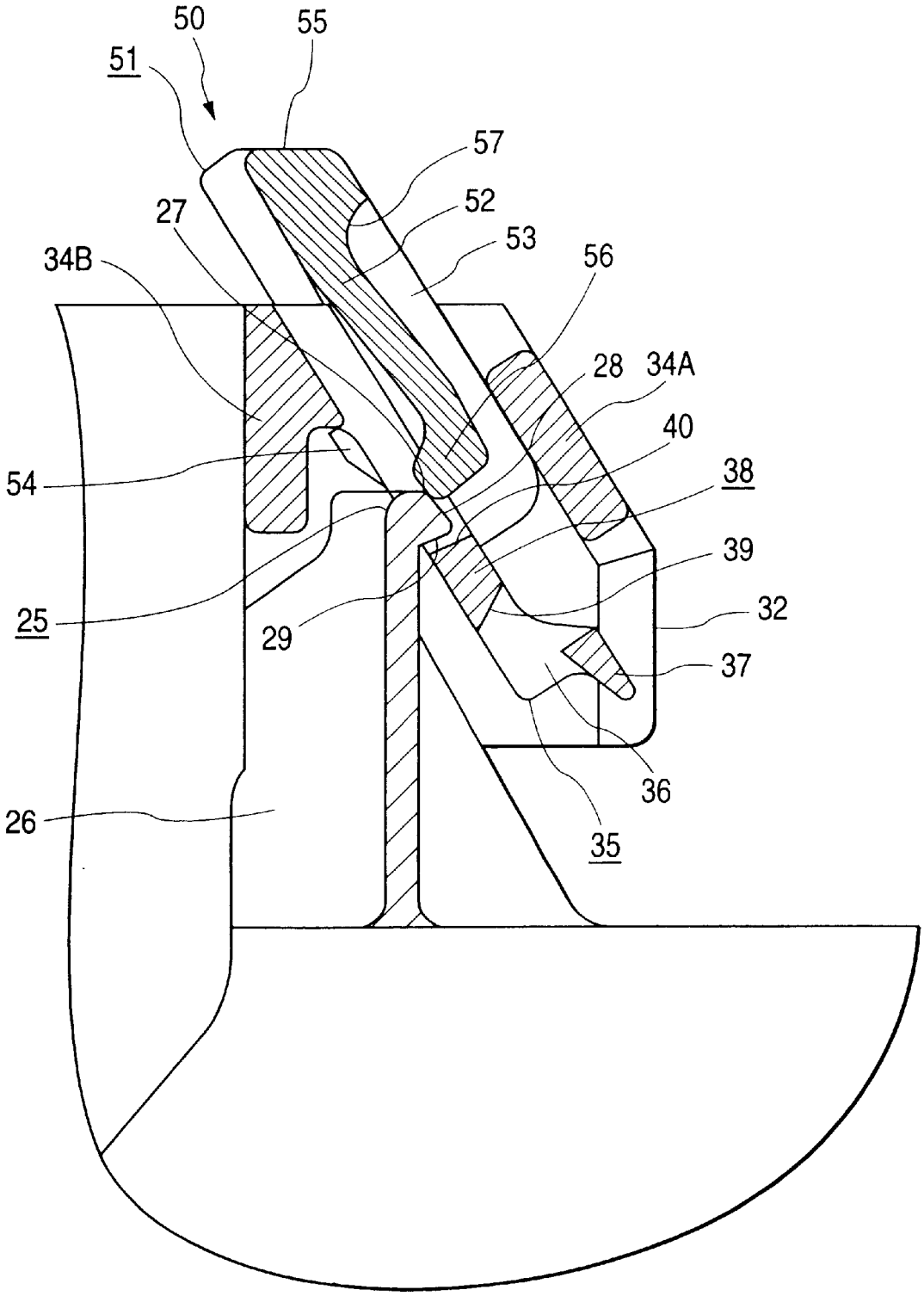
FIG. 12 is an enlarged sectional side view of FIG. 11.

The lock part 25 is provided on the upper face of the male housing 20 at a center in its width wise direction projecting upward, as shown in FIGS. 1 and 4. This lock part 25 has a pair of wall portions 26 which are integrally formed with the hood 21 in front of them, upright in a backwardly ascending manner, and connected with each other at their backward ends. On a top of the connected portions, is formed a guide face 27 in an arcuate shape, as shown in FIG. 5, which is adapted to guide a riding motion of the engaging portion 38 of the lock arm 35 on the lock part 25. On a backward side of the guide face 27, is formed a straight diagonal face 28 extending diagonally downwardly to the right. A backward end of the straight diagonal face 28 is recessed in a step diagonally downwardly to the left to form a locking step portion 29. As shown in FIG. 12, the engaging face 40 of the engaging portion 38 of the lock arm 35 is adapted to be engaged with the locking step portion 29.

Figure 14:
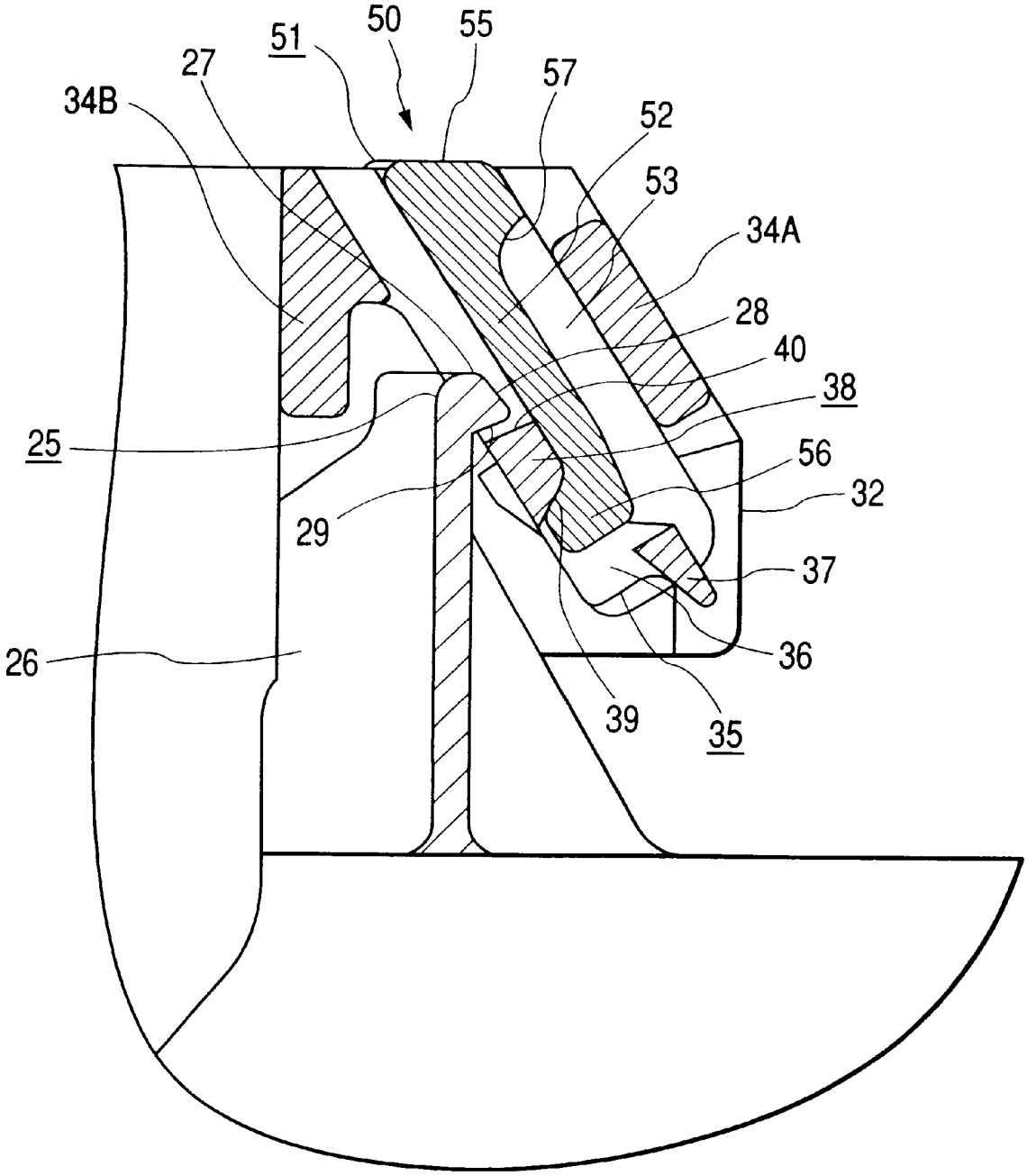
FIG. 14 is an enlarged sectional side view showing a state wherein the pushing movement of the detecting body has been completed.

As shown in FIG. 1, a detecting body 50 can be assembled to the lock arm 35 in the open space between the bridge portions 34A and 34B of the lever 30. This detecting body 50 is assembled in such a manner that its forward portion in the drawings is projected outward from the lever 30 before the lever 30 is rotated. After the lever 30 has been normally rotated, the detecting body 50 can be pushed until a projected end face (a pushing end face 55) of the detecting body 50 becomes flush with the outer face of the lever 30 as shown in FIG. 14.

Figure 6:
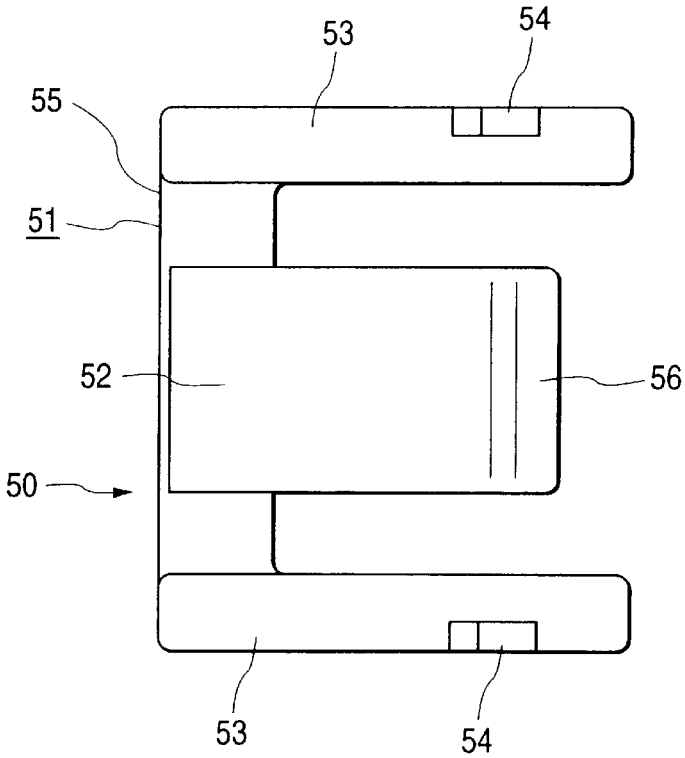
FIG. 6 is a bottom view of a detecting body.
Figure 7:
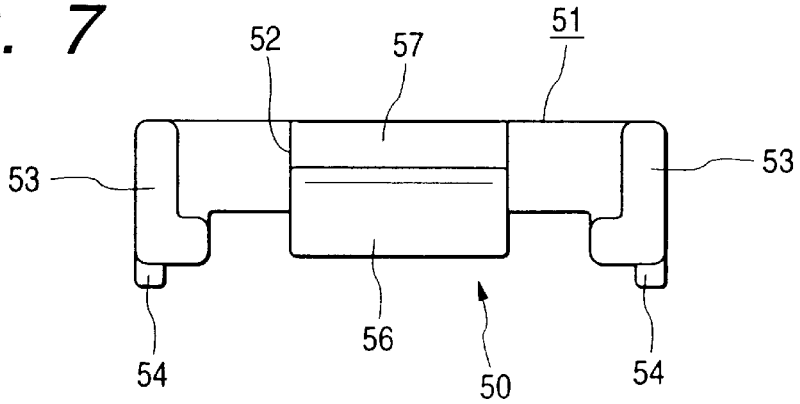
FIG. 7 is a front view of the detecting body.

As shown in FIG. 6, this detecting body 50 consists of a main body 51 substantially in a shape of a gate, and a flexible piece 52 provided in a cantilever form at a center of the main body 51 in a widthwise direction thereof. At both ends of the main body 51, are provided a pair of engaging arms 53 which are provided with claws 54 on respective lower faces thereof and formed in an L-shape as seen from the front side as shown in FIG. 7. Both the engaging arms 53 are inserted outside the lock arm 35 as shown in FIG. 3, and engaged between the upper and lower bridge portions 34A and 34B as shown in FIG. 1. Thus, the detecting body 50 can be moved along the open space between the bridge portions 34A and 34B, that is, in a direction along the rotation direction of the lever 30. The claws 54 are locked with the lower bridge portion 34B to prevent the detecting body 50 from being detached forward. The end face of the main body 51 projected from the lever 30 defines the pushing end face 55 which can be pressed when the detecting body 50 is moved to be pushed in.

Figure 8:
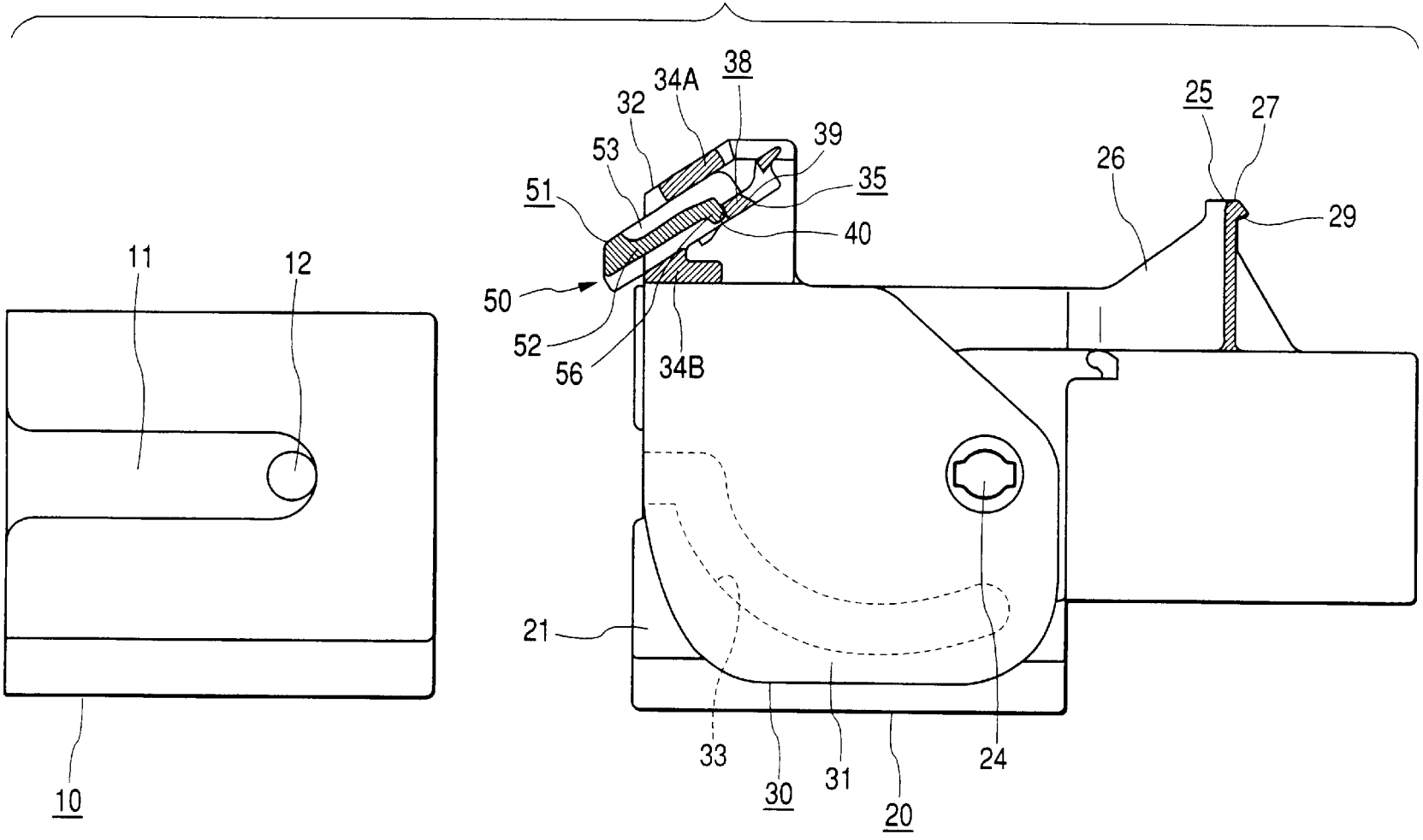
FIG. 8 is a side view partly cut away showing a state wherein pushing movement of the detecting body is restricted.

The flexible piece 52 is flexibly deformable making the connected parts with the main body 51 as base ends, and inserted between both the arm portions 36 of the lock arm 35 as shown in FIG. 4. A locking claw 56 is provided on a lower face of a free end of the flexible piece 52, as shown in FIG. 8. A distal end face of the locking claw 56 is adapted to be abutted against the engaging face 40 of the engaging portion 38 of the lock arm 35, whereby the pushing motion of the detecting body 50 will be restricted. After the lever 30 has been normally rotated, the engaging portion 38 of the lock arm 35 is positioned beyond the lock part 25 as shown in FIG. 12, and the locking claw 56 is brought into contact with the guide face 27 of the lock part 25. The pushing movement of the detecting body 50 is guided by the guide face 27. After the detecting body 50 has been pushed in, the locking claw 56 is adapted to be locked with the tip end face 39 on the opposite side to the engaging face 40 as shown in FIG. 14.

As shown in FIG. 1, a disengaging step 57 is formed on an upper face of the flexible piece 52 at its base end part. After the detecting body 50 has been pushed in, there will be formed a gap between the disengaging step 57 and the upper bridge portion 34A of the lever 30 as shown in FIG. 14. A jig J for taking out the detecting body 50 can be inserted into this gap (See FIG. 15). The tip end face 39 of the engaging portion 38 of the lock arm 35 with which the locking claw 56 is locked is tapered so as to allow the locking claw 56 to be easily released from the locked state.

Figure 9:
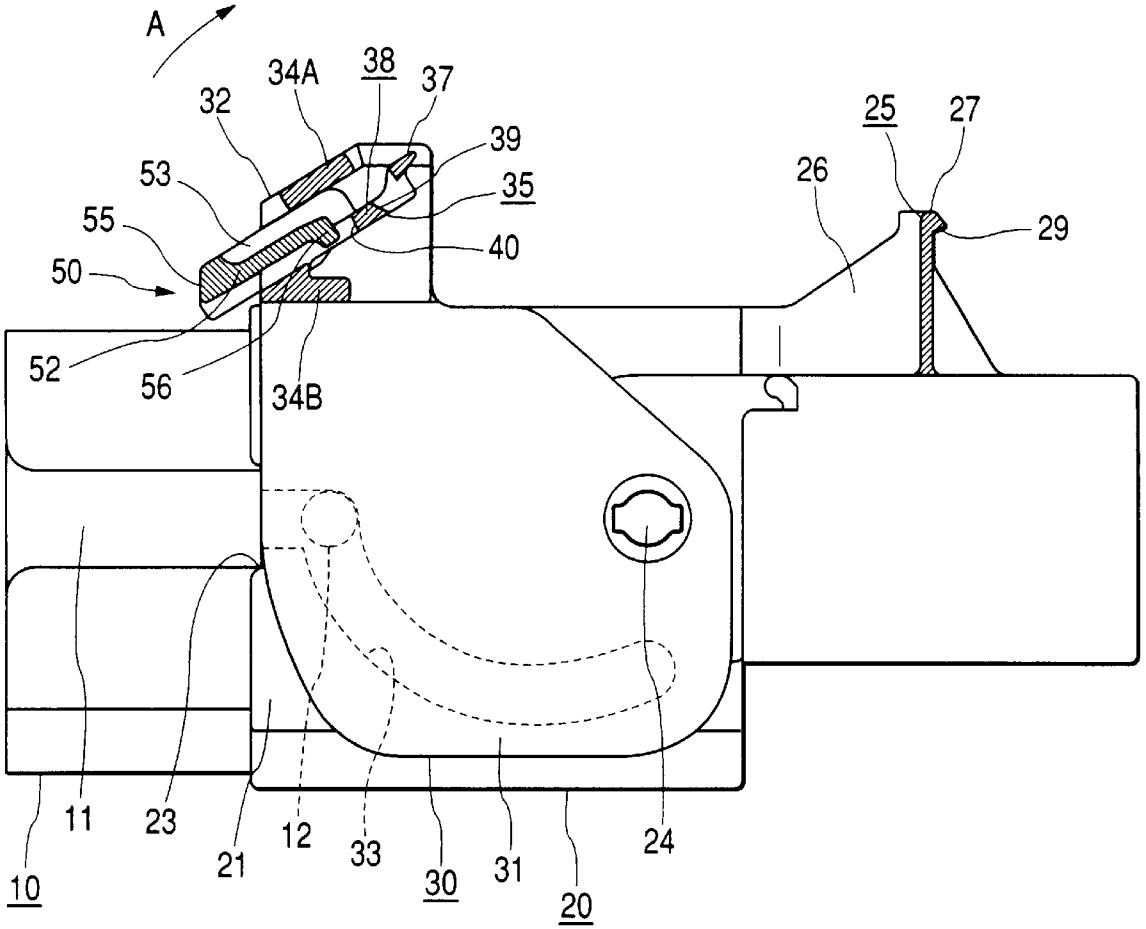
FIG. 9 is a side view partly cut away showing rotating operation of a lever.

The embodiment is constructed as above, and next, its operation will be described as follows; In a state where the female housing 10 is slightly engaged in the hood 21 of the male housing 20 to an extent that the follower pins 12 have entered into inlets of the cam grooves 33 as shown in FIG. 9, the lever 30 is rotated in a direction of the arrow A. Although an operator operates the lever30 to rotate it while manipulating the pushing end face 55 of the detecting body 50 projected from the lever 30 on this occasion, the pushing motion of the detecting body 50 is restricted by the locking claw 56 which is abutted against the engaging face 40 of the engaging portion 38 of the lock arm 35 (FIG. 8).

With the rotating motion of the lever 30, the tip end face 39 of the engaging portion 38 of the lock arm 35 is brought into contact with the guide face 27 of the lock part 25. The engaging portion 38 rides on the lock part 25 while being guided by the guide face 27, and the lock arm 35 is flexibly deformed. Since the engaging portion 38 has been deformed in a direction wherein it is further engaged with the locking claw 56 of the detecting body 50 on this occasion, the pushing movement of the detecting body 50 is still maintained in the restricted state. Meanwhile, as the lever 30 is further rotated, the follower pins 12 of the female housing 10 are introduced into the cam grooves 33, whereby the engagement between both the housings 10 and 20 will be advanced.

When the lever 30 has arrived at the normal position, and the engaging portion 38 has overridden the guide face 27 and the diagonal face 28 in the back as shown in FIGS. 11 and 12, the lock arm 35 is elastically restored to engage the engaging face 40 of the engaging portion 38 with the locking step portion 29, thereby to hold both the housings 10 and 20 undetachably. Since the flexible piece 52 of the detecting body 50 is slightly flexed with respect to the engaging portion 38, and the locking claw 56 has ridden on the guide face 27 of the lock part 25, the locking claw 56 will be disengaged from the locked condition with the engaging face 40. The restricted state of the detecting body 50 by means of the engaging portion 38 of the lock arm 35 will be released in this manner.

Figure 13:
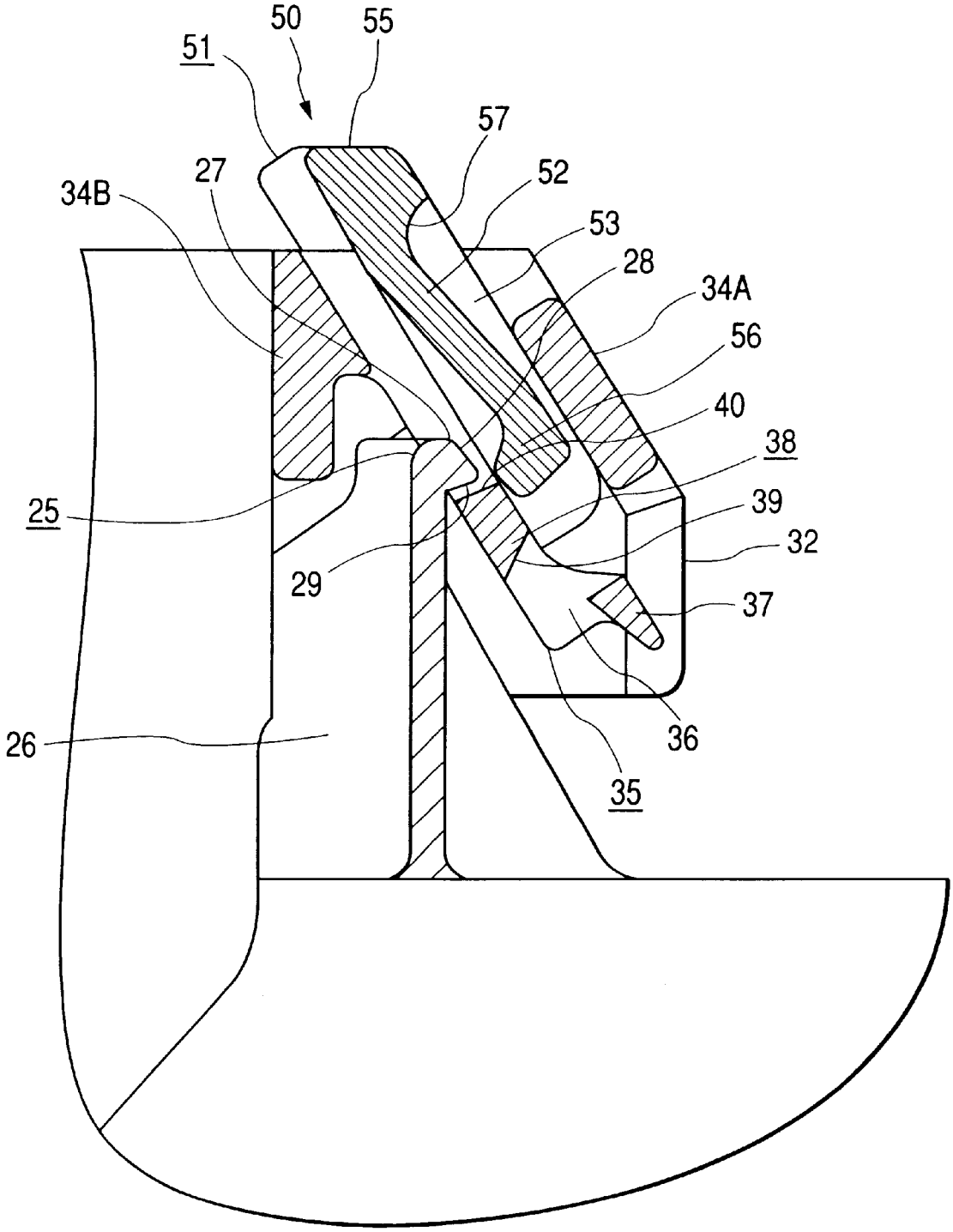

In this state, following the rotating operation of the lever 30, the operator manipulates the pushing end face 55 of the detecting body 50 to push the detecting body 50 in the same direction as the rotation direction of the lever 30. As shown in FIG. 13, the flexible piece 52 is further flexed and the locking claw 56 is guided into the depth along the guide face 27, to conduct the pushing movement of the detecting body 50. When the locking claw 56 has overridden the lock part 25 and the engaging portion 38, the flexible piece 52 is elastically restored to lock the locking claw 56 with the tip end face 39 of the engaging portion 38. Since the engagement of the lock arm 35 with the lock part 25 has been locked also by means of the detecting body 50, the locked condition can be maintained more rigidly. On this occasion, the pushing end face 55 of the detecting body 50 has been made flush with the outer face of the lever 30. By moving the detecting body 50 to push in this manner, it will be detected that the lever 30 has been rotated up to the normal position, and both the housings 10 and 20 have been normally engaged and held undetachably.

Figure 15:
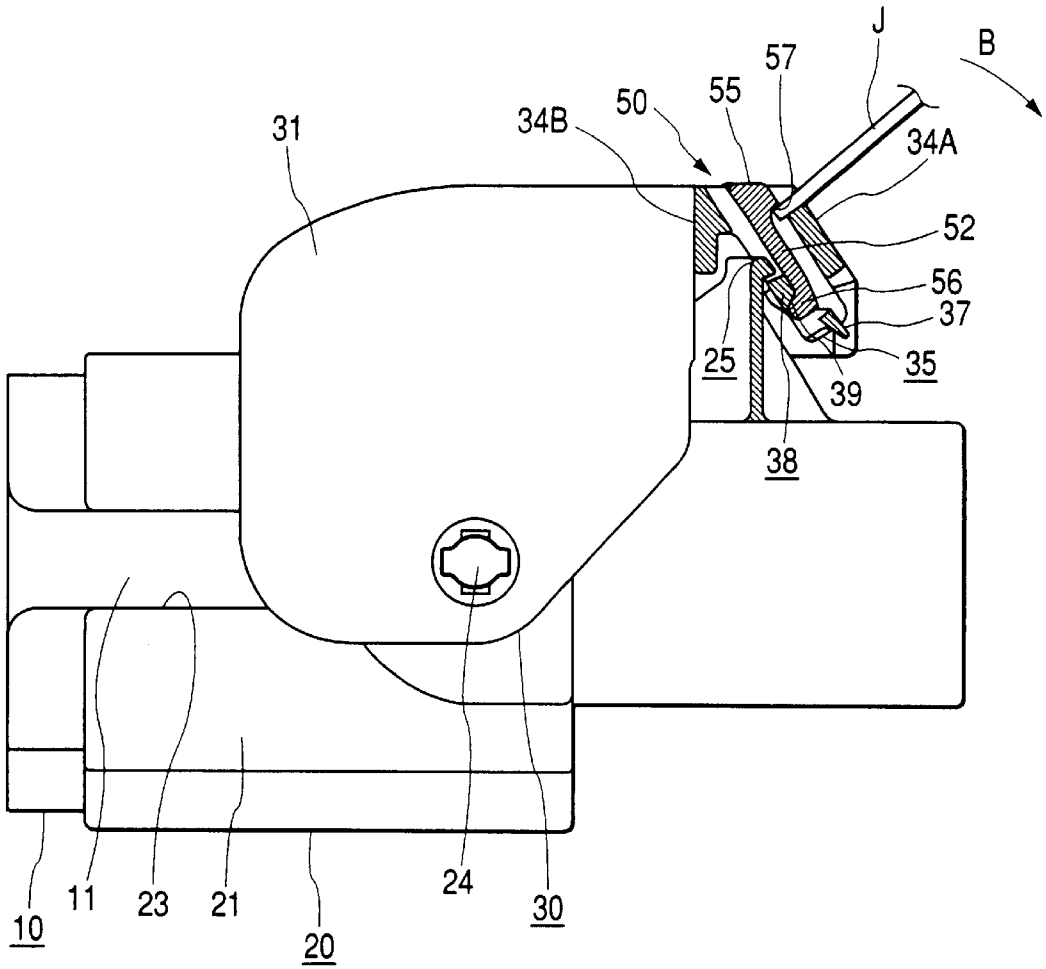
FIG. 15 is a side view partly cut away showing a withdrawing operation of the detecting body.

By the way, there are some cases in which both the housings 10 and 20 must be detached due to circumstances of maintenance, etc. In such cases, in order to release the engaged state of the lock arm 35 with the lock part 25, the jig J is inserted into the gap between the upper bridge portion 34A of the lever 30 and the disengaging step 57 of the detecting body 50 as shown in FIG. 15. Then, the jig J is hooked on the engaging step 57 and actuated in a direction of an arrow B to withdraw the detecting body 50. Because the tip end face 39 of the engaging portion 38 of the lock arm 35 is tapered, the locking claw 56 will be smoothly released from the engaged state. After the lock by the detecting body 50 has been released, the lever 30 is rotated in an opposite direction to the direction at engaging while lifting the operating portion 37 of the lock arm 35, and then, the female housing is removed.

As described above, according to the embodiment, the pushing movement of the detecting body 50 is restricted unless the lever is rotated to the normal position and the lock arm 35 is engaged with the lock part 25. Accordingly, whether the lever has been normally rotated or not can be reliably detected, by learning whether or not the pushing movement of the detecting body 50 is possible. Because this detecting body 50 has a simple structure as compared with the detecting apparatus of the electrical type in the conventional case, it is possible to impart an engagement detecting function to the connector at a low cost without incurring a large size of the connector. Moreover, because both the riding motion of the lock arm 35 on the lock part 25 and the pushing movement of the detecting body 50 can be guided by the single guide face 27, a compact structure can be realized.

Further, by assembling the detecting body 50 to the lever 30, the operation of pushing the detecting body 50 can be naturally incorporated in the operation of rotating the lever 30. Therefore, there is no need of conducting a particular operation for the detecting work of the detecting body 50, and workability will not be sacrificed.

<Other embodiments>

The invention is not limited to the embodiment which has been explained referring to the above description and the drawings, but the following other embodiments, for example, are included in a technical scope of the invention, and further, various modifications can be made besides the described below within a range in which their concepts are not deviated from the invention.

(1) In the above described embodiment, the lever is provided with the lock arm, while the male housing is provided with the lock part. However, on the contrary, the lever may be provided with the lock part, while the male housing may be provided with the lock arm.

(2) In the above described embodiment, the lever and the male housing having the lever are provided with the lock arm and the lock part respectively. However, the female housing which has not the lever may be provided with the lock arm and the lock part.

(3) In the above described embodiment, the connector of the lever type has been described. However, the invention can be applied to those connectors which are not provided with the lever. In this case, one of a pair of the connector housings which can be displaced linearly to be engaged with each other may be referred to as "the connector housing" described in claim 1, while the other of the connector housings may be referred to as "the member which is relatively displaced with respect to the connector housing" described in claim 1, and at the same time, the detecting body may be assembled to either one of the connector housings.

What is claimed is:

1. A locking mechanism in a connector, comprising:

a connector housing;

the lever which is relatively displaced with respect to the connector housing, a lock arm and a lock part respectively provided on the lever and the connector housing and adapted to engage with each other to hold the connector housing and the lever undisplaceably, the lock arm being adapted to be elastically restored and engaged with the lock part after the lock arm has been flexibly deformed with relative displacement of the connector housing and the lever while overriding the lock part;

a detecting body pushable in a direction of the relative displacement of the connector housing, the lever being assembled to either one of the lock arm and the lock part;

a guide face for guiding an overriding motion of the lock arm being provided on a tip end of a counterpart of the one to which the detecting body is assembled, the detecting body being abutted against an engaging part of the lock arm or the lock part to which the detecting body is assembled thereby to restrict pushing movement of the detecting body during the displacement of the connector housing and the lever, while the engaging part is engaged with the counterpart when both the connector housing and the lever have arrived at a position where they are held, whereby the restricted condition of the detecting body is released and the pushing movement of the detecting body is guided along the guide face;

a mating connector housing engageable with the connector housing, and either one of the connector housing and the mating connector housing is provided with a lever engaged with the other of the connector housing and the mating connector housing and adapted to bring both the connector housing and the mating connector housing into an engagement by a rotating operation of the lever; and wherein the lock arm and the lock part are respectively provided on the lever and on either one of the connector housing and the mating connector housing, and the detecting body is assembled to the lever, whereby when the lever has been normally rotated, the lock arm and the lock part are engaged with each other to normally engage both the connector housing and the mating connector housing with each other and the detecting body is released from the restricted condition and allowed to be moved and pushed in the same direction as the rotation direction of the lever.

2. A locking mechanism in a connector as claimed in claim 1, wherein when the detecting body is pushed in, the detecting body is flexibly deformable while riding on the lock arm and the lock part, and a pushing end of the detecting body is provided with a locking claw which is lockable with an opposite side to the engaging part in the one of the lock arm and the lock part to which the detecting body is assembled.

* * * * *